United States Patent [19]

Schneider

[11] 4,009,659

[45] Mar. 1, 1977

[54] MECHANISM FOR SECURING PRINTING PLATE CLAMPING DEVICES ON FORME CYLINDERS

[75] Inventor: Georg Schneider, Wurzburg, Germany

[73] Assignee: Koenig & Bauer Aktiengesellschaft, Wurzburg, Germany

[22] Filed: July 14, 1975

[21] Appl. No.: 596,030

[30] Foreign Application Priority Data

Aug. 8, 1974 Germany ..... 2437758

[52] U.S. Cl. ..... 101/415.1; 101/378; 403/374

[51] Int. Cl.[2] ..... B41F 27/06

[58] Field of Search ..... 101/415.1, 378; 403/374, 368, 370, 409

[56] References Cited

UNITED STATES PATENTS

| | | | |
|---|---|---|---|
| 1,730,122 | 10/1929 | Busk | 101/415.1 |
| 1,827,300 | 10/1931 | Pritchard et al. | 101/415.1 |
| 2,014,985 | 9/1935 | Robinson | 101/415.1 |
| 2,236,230 | 3/1941 | Worthington | 101/378 |
| 2,357,797 | 9/1944 | Hauer | 101/378 X |
| 2,578,406 | 12/1951 | Dutro | 101/415.1 |
| 2,745,344 | 5/1956 | Brodie | 101/415.1 |
| 2,768,579 | 10/1956 | Fies | 101/415.1 |
| 2,775,198 | 12/1956 | Johnson et al. | 101/415.1 |
| 2,898,854 | 8/1959 | Crawford | 101/415.1 |
| 2,929,323 | 3/1960 | Burgard | 101/415.1 |
| 2,973,710 | 3/1961 | Hantscho | 101/415.1 |
| 3,020,842 | 2/1962 | Neal | 101/415.1 |

*Primary Examiner*—Clifford D. Crowder
*Assistant Examiner*—Paul J. Hirsch
*Attorney, Agent, or Firm*—Jones, Tullar & Cooper

[57] ABSTRACT

A mechanism for securing mounting blocks for printing plate clamping devices on forme cylinders is disclosed. A mounting block for receiving the printing plate clamping device is located in a paraxial groove formed in the cylinder and is secured therein by means of a pair of longitudinally movable locking bars which are shiftable in longitudinal notches formed on the sides of the mounting block. Means are provided for adjusting the locking bars longitudinally in the locking and releasing directions to selectively secure the mounting block in place or to release it for removal from the groove.

9 Claims, 11 Drawing Figures

MECHANISM FOR SECURING PRINTING PLATE CLAMPING DEVICES ON FORME CYLINDERS

BACKGROUND OF THE INVENTION

The present invention relates to a mechanism for securing mounting blocks for printing plate clamping devices on forme cylinders preferably of offset rotary printing presses.

In offset rotary printing presses it is necessary to securely clamp the printing plate on the outside surface of the forme cylinder, and for this purpose a printing plate clamping device is normally provided. However, since such printing plate clamping devices are continuously subjected to paper dust, ink, washing solutions, and the like, it must from time to time be dismantled for cleaning or any repairs that might be necessary. Because the printing press cannot be used during such cleaning or repairing, a reduction of the down time required for this purpose to insure minimum loss of time is desirable.

In designing a printing plate clamping device, one of the objectives is to make maximum use, for printing purposes, of the peripheral area available on the forme cylinder and accordingly it is desirable to make as small as possible the print-free space on the cylinder, i.e., the space which cannot be used for printing purposes as a result of the geometrical shape or condition of the printing plate clamping mechanism. To accomplish this, the mechanism of the printing plate clamping device is partly mounted in a cavity in the forme cylinder. The cavity is provided with a slot which is as narrow as possible and which opens to the surface of the cylinder, through which the end portions of the printing plate to be clamped are introduced into the printing plate clamping device. As required by the different constructions of available printing plate clamping devices, the cavities in the forme cylinder which receive the clamping devices have more or less complex inside cross sections.

The prior art suggests various possible methods for providing the cavities in the forme cylinder. For example, one or more inserts of a relative shape may be mounted into a paraxial canal, that is, a canal which extends parallel to the axis of the cylinder, or a properly sized hole may be drilled through the length of the cylinder. However, exact drilling of such long holes is difficult. The inserts are secured within the forme cylinder body by means of bolts, screws, or similar fasteners, with the fasteners extending from either the inner or the outer surface of the forme cylinder body. When the screws are inserted from the outer surface, the screwheads that protrude from the fitting holes are removed, as by turning, with the peripheral surface of the cylinder thereafter being ground so that a uniform smooth surface will result. It goes without saying that the screws holding the inserts in the forme cylinder body can no longer be removed.

With such prior arrangements mounting the printing plate clamping devices is not possible until the inserts have been firmly secured to the forme cylinder body. Further, because of the need to provide a print-free space as small as possible on the surface of the cylinder, the printing plate clamping device cannot be introduced, in many cases, into the cavity from the surface of the forme cylinder. This means that the printing plate clamping device must be mounted into the forme cylinder before the cylinder is mounted into its supporting side frame in the printing press. This is particularly true because it is impossible to introduce the long shafts, required for opening and closing the printing plate clamping device from the forme cylinder front side, into the inserts due to the space between the side frames and the forme cylinder front side having only a few centimeters of width. For the same reason, it is impossible to remove the printing plate clamping device from the forme cylinder as long as the cylinder remains mounted in the side frames. However, such dismantling of the printing plate clamping device may become necessary, for example, in order to replace a defective part, or else for cleaning the device carefully for guaranteeing its continued operation.

SUMMARY OF THE INVENTION

It is, therefore, an object of the present invention to provide a mechanism by means of which the printing plate clamping device can be removed from the forme cylinder while the cylinder is still mounted into its two side frames in spite of a small print-free clearance in the surface of the forme cylinder, without the necessity of dismantling the forme cylinder from the offset rotary printing press.

Briefly, the foregoing is accomplished by means of a mounting block which carries the printing plate clamping devices. The mounted block is positioned in a paraxial groove formed in the surface of the forme cylinder, with the cross section of the mounting block and the groove corresponding to each other and the top surface of the block following the shape of the surface of the cylinder. At least one locking bar is mounted in a groove at the bottom of the paraxial channel and means are provided for shifting the locking bar longitudinally within its groove. The mounting block and the locking bar carry complementary inclined surfaces which engage each other as the locking bar is shifted so that the mounting block is securely locked in the channel.

The advantages resulting from the present invention are, intealia, that the print-free clearance on the surface of the forme cylinder is made small, but in spite of this the printing plate clamping device can be dismantled from the cylinder while the cylinder is still mounted in the offset rotary printing press. Furthermore, the present invention insures that it will no longer be necessary to provide the complicated cavity shape for installation of the printing plate clamping device which the prior art required in the forme cylinder. Dismantling the printing plate clamping device can, therefore, be done quickly because it is no longer necessary to dismantle the whole forme cylinder. It will be understood that the present invention is not confined to forme cylinders and that it may be applied to offset blanket cylinders as well.

BRIEF DESCRIPTION OF THE DRAWINGS

The foregoing and additional objects, features and advantages of the invention will be more fully understood from a consideration of a preferred embodiment of the invention described by way of example, with reference to the accompanying drawings, in which.

DESCRIPTION OF A PREFERRED EMBODIMENT

Figure 1:
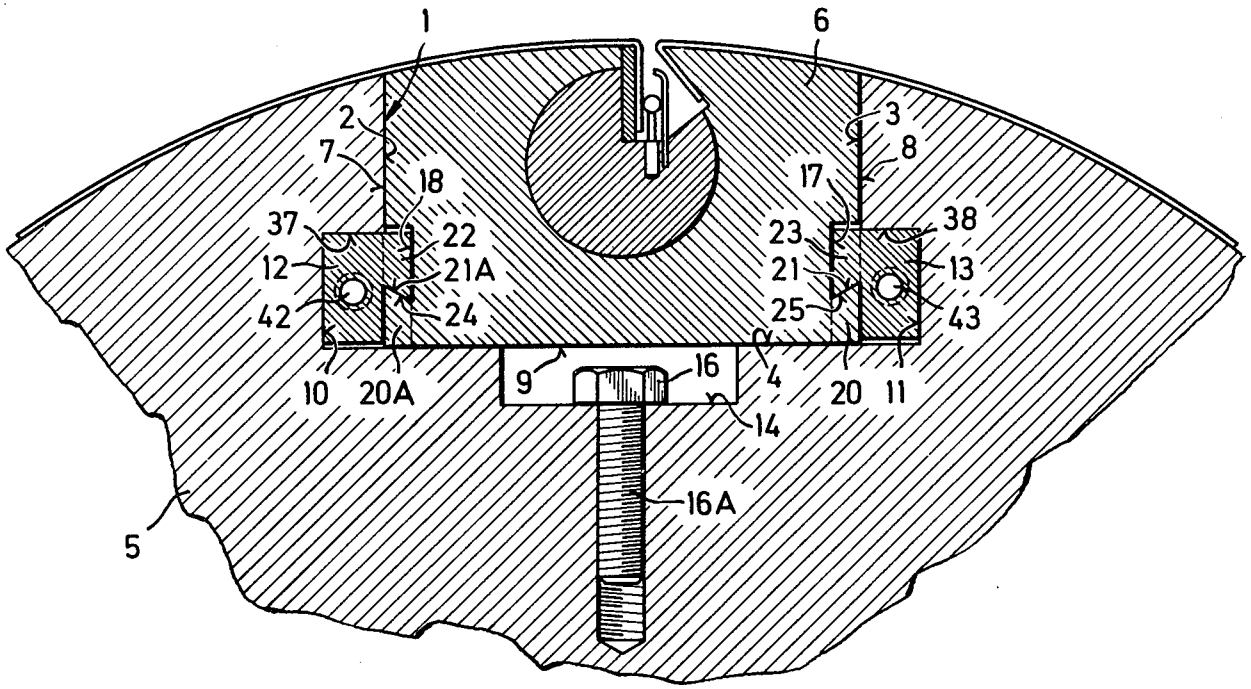
FIG. 1 is a sectional view taken through a forme cylinder showing a mounting block secured therein in accordance with the present invention and carrying a printing plate clamping device.

As illustrated in FIG. 1 of the drawings, a groove 1, defined by lateral surfaces 2 and 3 and a bottom surface 4, is formed in a forme cylinder 5. The groove, or channel, is paraxial to the cylinder; that is, it extends in a direction longitudinally of the cylinder and parallel to its axis, and is generally rectangular in cross section. Secured within the groove 1 is a mounting block 6 for a printing plate clamping device which, in the present specification, will be designated simply as a mounting block 6. Lateral surfaces 7 and 8 and a bottom surface 9 define the generally rectangular mounting block. Formed in the lateral surfaces 2 and 3 of the groove 1 are a pair of guiding notches 10 and 11, respectively which extend the length of the groove and are adapted to receive corresponding locking bars 12 and 13, respectively, which can be shifted in a longitudinal direction through the notches.

Figure 8:
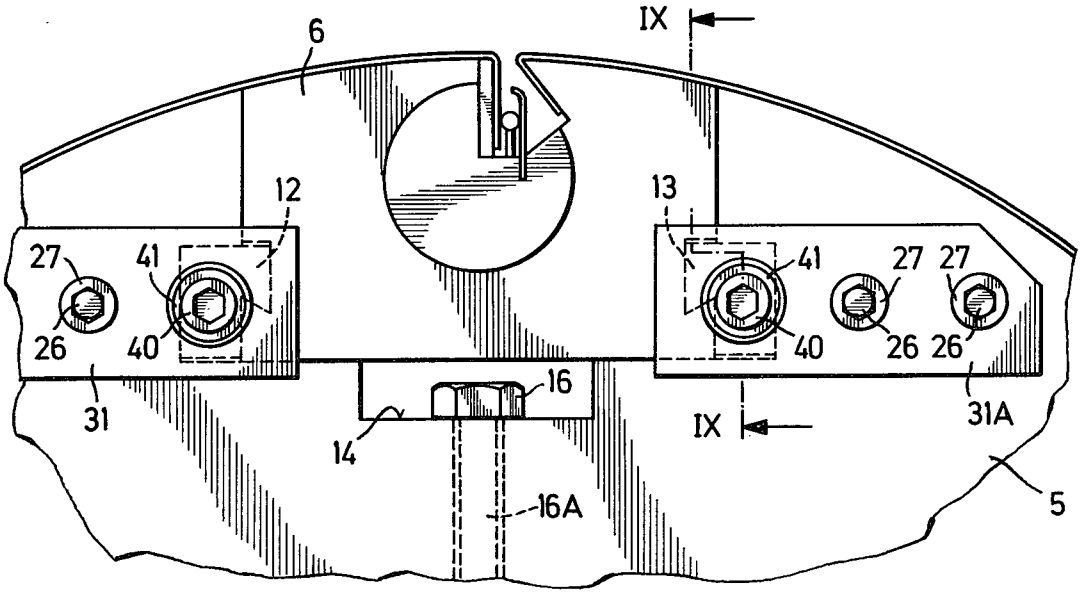
FIG. 8 is an elevation view of a portion of the left hand end of the forme cylinder, showing the locking bar release mechanism.

A cavity 14 is formed in the bottom surface 4 of the groove 1 into which the screwheads 15 and 16 of the disassembling screws 15A and 16A, respectively, extend. These screws are accessible from each end of the forme cylinder 5, as may be seen in FIGS. 8 and 10, and by loosening the disassembling screws 15A and 16A from their threads in the forme cylinder 5, the mounting block 6 can be pressed out of the groove 1 after it has been unlocked.

Figure 2:
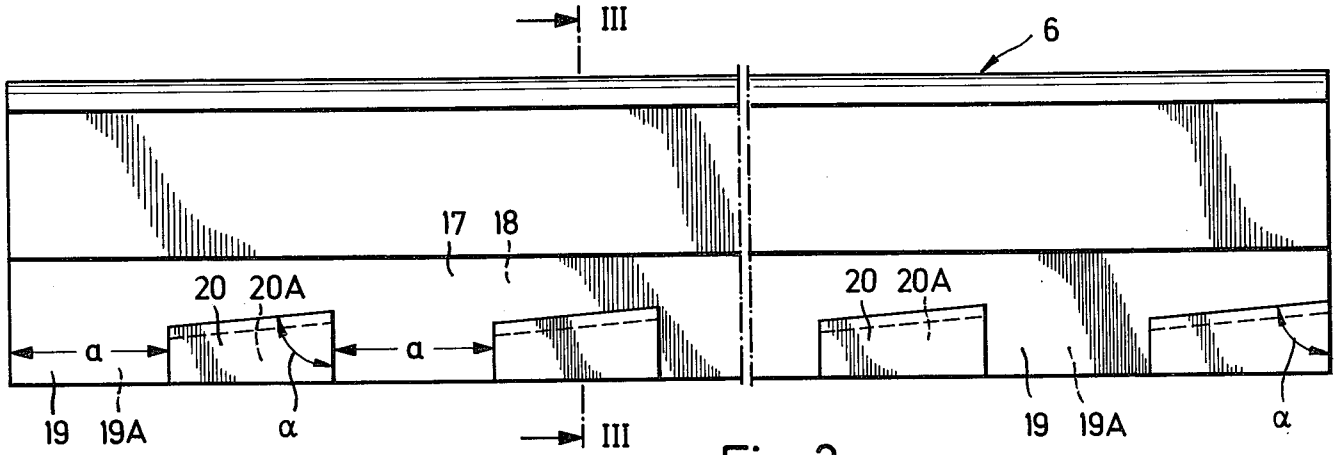
FIG. 2 is a side elevation view of the mounting block of FIG. 1, removed from the forme cylinder.
Figure 3:
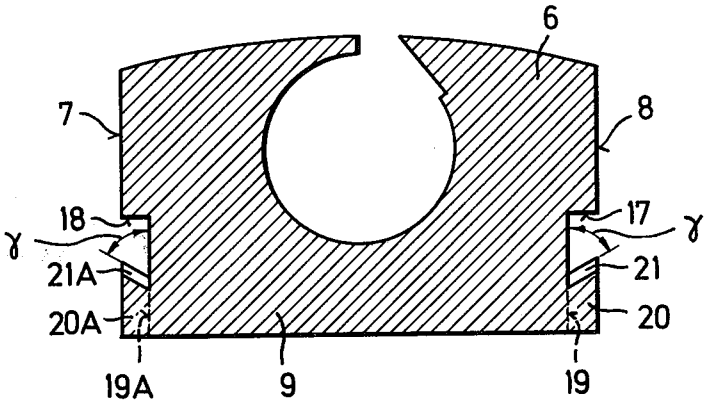
FIG. 3 is a sectional view of the mounting block, taken along line III—III of FIG. 2.

Each of the lateral surfaces 7 and 8 of the mounting block 6 is provided with a longitudinal notch, as illustrated in FIGS. 2 and 3. Notches 17 and 18 are formed in surfaces 7 and 8, respectively, and pass the length of the mounting block. These notches also extend downwardly toward the lower part of the mounting block at spaced intervals to form a number of vertical notches 19 and 19A on the lateral surfaces 8 and 7, respectively. Between the vertical notches 19 and 19A the remaining portions of the mounting block form a plurality of locking counterparts, or shoulders, 20 and 20A. Each of the locking shoulders 20, 20A has an inclined upper, or pressing, surface as indicated at 21 and 21A, respectively. The locking shoulders are separated by the vertical notches, with the gap $a$ between adjacent shoulders being preferably always identical. All of the pressing surfaces 21 and 21A are inclined under the identical angle $\alpha$ with respect to longitudinal direction of the mounting block 6, as illustrated in FIG. 2. Furthermore, the pressing surfaces 21 and 21A may have a cross inclination indicated by the angle $\gamma$, as illustrated in FIG. 3. The bottom surfaces 4 and 9 of the channel and the mounting block correspond as regards their shape.

Figure 4:
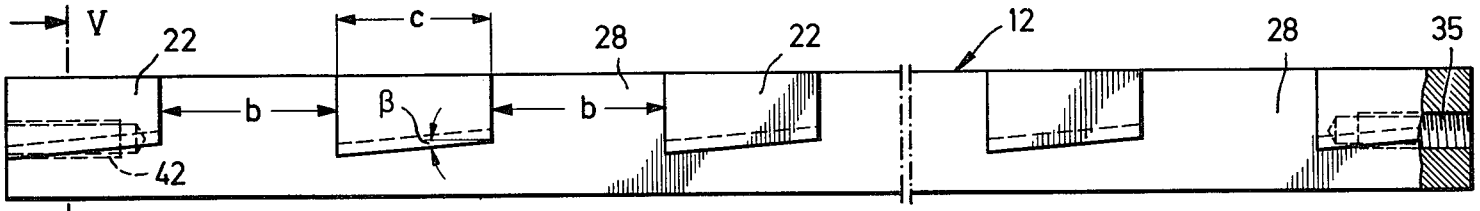
FIG. 4 is a front elevation view of the locking bar securing the left hand side of the mounting block as viewed in FIG. 1.
Figure 6:
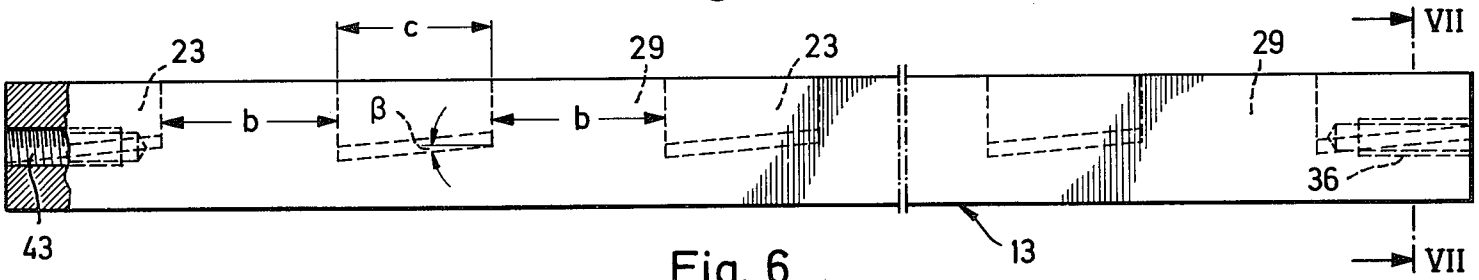
FIG. 6 is a back elevation view of the locking bar securing the right hand side of the mounting block, as viewed in FIG. 1.
Figure 5:
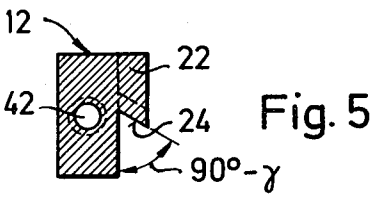
FIG. 5 is a sectional view of the locking bar of FIG. 4, taken along line V—V.
Figure 7:
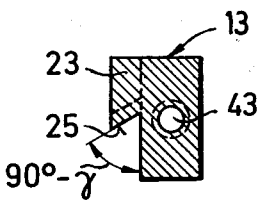
FIG. 7 is a sectional view of the locking bar of FIG. 6, taken along line VII—VII thereof.

The locking bars 12 and 13, which are provided for locking the mounting block within the body of the forme cylinder 5, are illustrated in FIGS. 4 through 7. Although the locking bars are similar to each other, they are mirror images and thus are not interchangeable. This is advantageous since it makes possible the locking of the mounting block from one end of the forme cylinder and similarly makes possible its unlocking from the other end thereof. Each of the locking bars 12 and 13 is provided with a plurality of laterally projecting locking pieces. As illustrated in FIG. 4, which is a front view of the locking bar 12, the bar is formed with locking pieces 22 which are disposed in a longitudinal direction on the bar and spaced the same distance $b$ from each other. Similarly, as illustrated in FIG. 6, the locking bar 13 includes a plurality of locking pieces 23 disposed in a longitudinal direction along the bar. It will be noted that FIG. 6 is a rear view of the locking bar 13, and accordingly the locking pieces are shown in phantom. Again, the locking pieces 23 are spaced apart by the distance $b$. Each of the locking pieces 22 and 23 terminates on its lower surface in an inclined pressing surface, indicated at 24 for the locking pieces 22 and at 25 for the locking pieces 23. The lower pressing surfaces 24 and 25 are inclined in a longitudinal direction at an angle $\beta$, as illustrated in FIGS. 4 and 6. In the cross sections, illustrated in FIGS. 5 and 7, the pressing surface 24 and 25 may be inclined in cross direction to the locking bars 12 and 13, respectively, under the angle $90° - \gamma$. This inclination is required if the pressing surfaces 21 and 21A of the mounting block 6 are inclined under the angle $\gamma$.

The gap $a$ between each of the locking shoulders 20 and 20A is approximately one millimeter greater than the length $c$ of each of the locking pieces 22 and 23. This insures that the locking pieces 22 and 23 will fit easily through the notches 19 and 19A between the locking shoulders 20 and 20A. The inclination angles $\alpha$ and $\beta$ of the locking counterparts 20, 20A and the locking pieces 22, 23 are complementary, and equal 90°.

The following operations are required in order to lock the mounting block 6 within the body of the forme cylinder 5. Starting with the mounting block removed from the groove, or channel 1, the locking bars 12 and 13 are introduced through the groove 1 into their corresponding guiding notches 10 and 11. When so positioned, the locking pieces 22 and 23 on the locking bars project into the groove 1, as may be seen in FIG. 1. Thereafter, the mounting block 6 is inserted into the paraxial groove 1 and the locking bars 12 and 13 are shifted in their longitudinal directions within their guiding notches 10 and 11 until the locking pieces 22 and 23 project into the vertical notches 19 and 19A. This allows the mounting block to pass by the locking pieces into the bottom of groove 1, where the locking shoulders 20 and 20A of the mounting block 6 come to rest in the locking bar intervals 28 and 29 located between the locking pieces 22 and 23, respectively.

Figure 11:
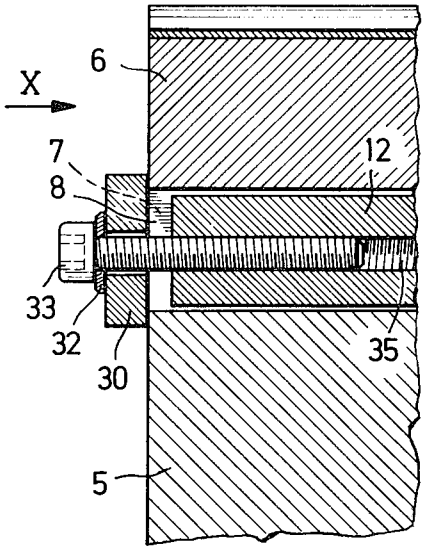
FIG. 11 is a sectional view along line XI—XI of FIG. 10.
Figure 10:
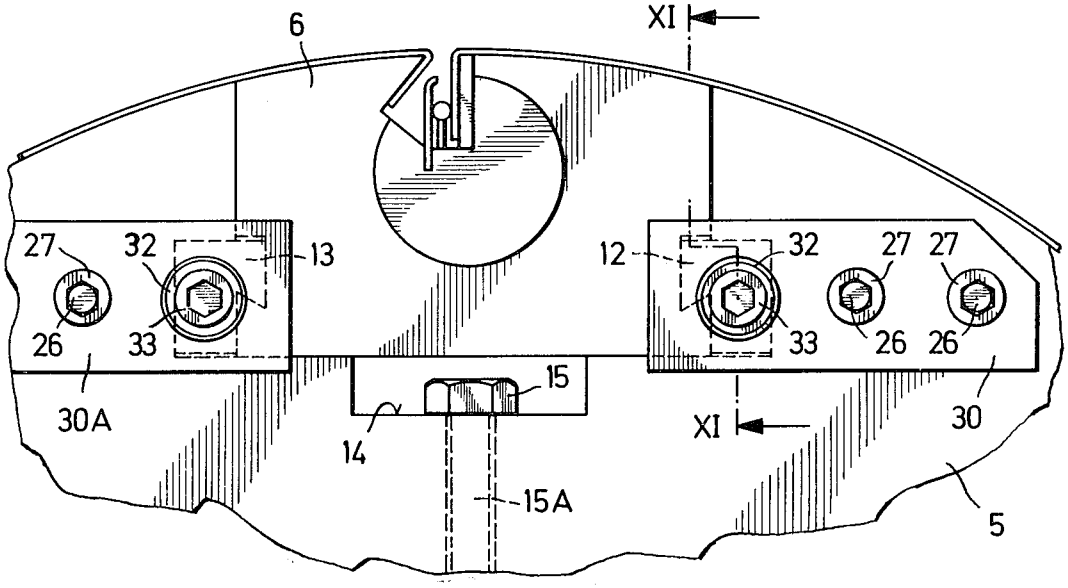
FIG. 10 is an elevation view of a portion of the right hand end of the forme cylinder, showing the locking mechanism.

Longitudinal movement of the mounting blocks and the locking bars is limited by means of locking stops 30, 30A (FIG. 10) releasing stops 31, 31A (FIG. 8) which are mounted on the left and right hand ends of the forme cylinder 5. These stops overlap the ends of groove 1 and the guiding notches 10 and 11 to prevent the mounting block and locking bars from sliding out of groove 1. The laterally extending locking pieces of the locking bars 12 and 13 may then be pulled along the longitudinal notches 17 and 18 of the mounting block 6 by means of a suitable mechanism for shifting the locking bars. Such a mechanism for shifting the bars in the "locking" direction is illustrated in FIGS. 10 and 11, and may consist of the locking stops 30, 30A mounted securely on the forme cylinder 5 by means of screws 26 and spring washers 27. Aligned with the guiding notches 10 and 11 and mounted in the locking stops 30 and 30A are discs, or washers, 32 and screws 33 having threads passing through the stops and extending into threaded blind holes 35 and 36, respectively, in the locking bars 12 and 13, as illustrated in FIG. 11. When the screws 33 engage the threaded holes in the locking bars and the screws are tightened, the locking bars 12 and 13 are pulled towards the locking stops 30 and 30A, thereby drawing the locking pieces 22 and 23 longitudinally along the mounting block 6 and into engagement with the locking shoulders, or counterparts, 20 and 20A, thereby engaging the upwardly facing pressing surfaces 21 and 21A with the corresponding downwardly facing pressing surfaces 25 and 24. Due to the presence of the locking stops 30, 30A the mounting block cannot follow the longitudinal locking movement of the locking bars 12 and 13. Contact of the inclined pressing surfaces of the locking shoulders 20 and 20A against the inclined pressing surfaces of the locking pieces 22 and 23, causes the locking bars initially to move both longitudinally along the guiding notches and upwardly in the direction of the forme cylinder surface until the tops of the locking bars engage the upper surfaces 37 and 38, respectively, of the guiding notches 10 and 11 (See FIG. 1),. Thereafter, any movement of the locking bars 12 and 13 is possible in the longitudinal direction only, and when such movement takes place, as by further tightening of the screws 33, the mounting block 6 is pressed by means of its locking counterparts 20 and 20A by the locking pieces 23 and 22, respectively, of the locking bars 13 and 12 against the bottom surface 4 of the groove 1. Upon termination of the locking operation, the mechanism for the shifting of the locking bars in the locking direction is secured and the mounting block is properly positioned and secured in the forme cylinder.

Figure 9:
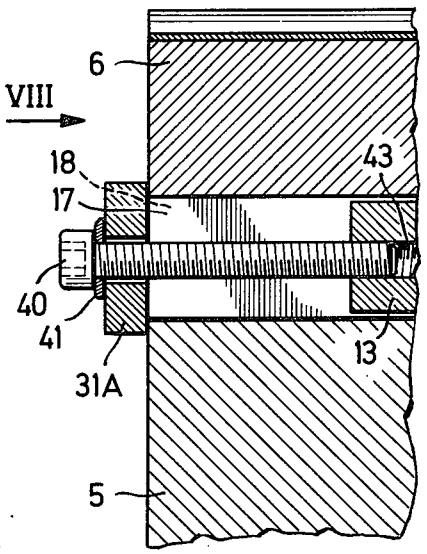
FIG. 9 is a sectional view along line IX—IX of FIG. 8.

To release the mounting block 6 from the groove 1, the locking bars 12 and 13 must be moved longitudinally along the guiding notches in a direction opposite to the locking direction just described. For doing this, a releasing mechanism is provided which consists, for example, in the releasing stops 31 and 31A illustrated in FIGS. 8 and 9. The releasing stops are secured to the end of the forme cylinder by means of screws 26 and spring washers 27, with the ends of the stops extending over the guide notches 10 and 11 as well as partially over the end of groove 1. Aligned with the end of the guiding notches 10 and 11 are releasing screws 40 which pass through discs, or washers, 41 into corresponding blind threaded holes 42 and 43 formed in the ends of the locking bars. By first loosening the locking screws 33 and then tightening the releasing screws 40, the locking bars 12 and 13 can be drawn longitudinally along the guiding notches 10 and 11 toward the releasing stops 31 and 31A until the locking pieces 22 and 23 are again aligned with the notches 19 and 19A of the mounting block at which time the screws 15A and 16A may be unscrewed to force the mounting block 6 out of the groove 1 for easy access to the clamping device.

It goes without saying that the cross sectional shapes of the mounting block 6, the groove 1, the locking bars 12 and 13 and the guiding notches 10 and 11, as shown on the drawings, are to be understood as an example only, and other cross sectional shapes are possible. For example, the groove 1 could be executed in the shape of a truncated "V." Further, the locking of the mounting block 6 at its bottom surface could be accomplished by means of one locking bar only.

What is claimed is:

1. A mechanism for securing a mounting block for a printing plate clamping device on a forme cylinder, comprising:

a groove formed in said forme cylinder parallel to the axis thereof;

a mounting block positionable in said groove, said mounting block having a cross-section similar to the cross-section of said groove, said mounting block further including a longitudinally extending notch and a plurality of spaced vertical notches defining a plurality of spaced locking shoulders;

a guiding notch formed in a wall of said groove and extending longitudinally of said groove;

a locking bar mounted in and longitudinally slidable within said guiding notch, said locking bar carrying a plurality of spaced locking pieces, said locking pieces extending into said mounting block notches, said locking pieces having inclined pressing surfaces engagable with said mounting block locking shoulders; and locking means for sliding said locking bar longitudinally along said guiding notch to bring said pressing surfaces of said locking pieces into locking engagement with said shoulders to secure said mounting block in said groove.

2. The mechanism of claim 1, wherein said locking shoulders are formed with inclined pressing surfaces corresponding to and engageable with the inclined pressing surfaces of said locking pieces.

3. The mechanism of claim 2, wherein said pressing surfaces are inclined with respect to the longitudinal direction of motion of said locking bar.

4. The mechanism of claim 2, wherein said locking bar is located to one side of said mounting block, wherein each of said longitudinally spaced locking pieces has a pressing surface inclined under an angle $\beta$ in the longitudinal direction of the locking bar, and wherein the mounting block carries said locking shoulders having pressing surfaces inclined under an angle $\alpha$ in the longitudinal direction of said lateral side, wherein the sum of the angles $\alpha$ and $\beta$ equals 90°.

5. The mechanism of claim 4 wherein the pressing surfaces of the locking shoulders are further inclined in the cross direction under the angle $\gamma$, and the pressing surfaces of the locking pieces are inclined under the angle $(90° - \gamma)$.

6. The mechanism of claim 1 wherein said locking means comprises screw means carried by a fixed locking stop and threaded into one end of said locking bar, whereby rotation of said screw means pulls said locking bar longitudinally to bring said locking pieces into locking engagement with said shoulders.

7. The mechanism of claim 6, further including releasing means for moving said locking bar in a disengaging direction to disengage said locking pieces from said shoulders.

8. The mechanism of claim 7, wherein said releasing means comprises second screw means carried by a fixed releasing stop and threaded into the opposite end of said locking bar, whereby rotation of said second screw means pulls said locking bar longitudinally in said disengaging direction.

9. The mechanism of claim 1, wherein said locking bar is located to one side of said mounting block, and further including a second similar locking bar mounted in a second guiding notch located at the opposite side of said mounting block, said second locking bar being a mirror image of said first locking bar.

* * * * *